US009234149B2

(12) United States Patent
Lau et al.

(10) Patent No.: US 9,234,149 B2
(45) Date of Patent: Jan. 12, 2016

(54) STEAM GENERATING SLURRY GASIFIER FOR THE CATALYTIC GASIFICATION OF A CARBONACEOUS FEEDSTOCK

(71) Applicant: GreatPoint Energy, Inc., Cambridge, MA (US)

(72) Inventors: Francis S. Lau, Darien, IL (US); Earl T. Robinson, Lakeland, FL (US)

(73) Assignee: GreatPoint Energy, Inc., Cambridge, MA (US)

( * ) Notice: Subject to any disclaimer, the term of this patent is extended or adjusted under 35 U.S.C. 154(b) by 0 days.

(21) Appl. No.: 14/637,578

(22) Filed: Mar. 4, 2015

(65) Prior Publication Data

US 2015/0175914 A1 Jun. 25, 2015

Related U.S. Application Data

(63) Continuation of application No. 12/343,149, filed on Dec. 23, 2008, now abandoned.

(60) Provisional application No. 61/017,321, filed on Dec. 28, 2007.

(51) Int. Cl.
*C10J 3/46* (2006.01)
*C10J 3/54* (2006.01)
(Continued)

(52) U.S. Cl.
CPC .. *C10J 3/82* (2013.01); *C10J 3/463* (2013.01); *C10J 3/721* (2013.01); *C10K 1/004* (2013.01);
(Continued)

(58) Field of Classification Search
CPC ..... C10J 3/721; C10J 3/463; C10J 3/82; C10J 2300/1253; C10L 3/08; C10L 3/102; C10K 1/004; C10K 1/101; C10K 1/122; C10K 1/143; C10K 1/16; C10K 1/165; C10K 3/02
USPC ..... 48/202, 206, 73, 87, DIG. 2, DIG. 7
See application file for complete search history.

(56) References Cited

U.S. PATENT DOCUMENTS 2,605,215 A 7/1952 Coghlan
2,694,623 A 11/1954 Welty, Jr. et al.
(Continued)

FOREIGN PATENT DOCUMENTS

CA 966660 4/1975
CA 1003217 1/1977
(Continued)

OTHER PUBLICATIONS

U.S. Appl. No. 12/778,538, filed May 12, 2010, Robinson, et al.
(Continued)

*Primary Examiner* — Jill Warden
*Assistant Examiner* — Joye L Woodard
(74) *Attorney, Agent, or Firm* — McDonnell Boehnen Hulbert & Berghoff LLP

(57) ABSTRACT

Steam generating gasification reactors for providing high-pressure and high-temperature steam for catalytic gasification of a carbonaceous feedstock can be based on oxygen blown gasification reactors adapted for processing a slurry feedstock comprising at least 40% water. The exhaust from the slurry gasifier comprises at least steam, carbon monoxide and hydrogen. The slurry composition and the oxygen to fuel ratio can be varied to control the ratio of carbonaceous gases in the generator exhaust. By directing substantially all of exhaust gases produced from the slurry gasification reactor through the catalytic gasifier and subsequent gas separation and sequestration processes, a greatly higher energy efficiency and decreased carbon footprint can be realized. The subsequent gas separation process produces a syngas stream which is recycled and directed into the slurry gasifier.

10 Claims, 2 Drawing Sheets

(51) Int. Cl.

| | |
|---|---|
| ***C10J 3/82*** | (2006.01) |
| ***C10J 3/72*** | (2006.01) |
| ***C10K 1/00*** | (2006.01) |
| ***C10K 1/10*** | (2006.01) |
| ***C10K 1/12*** | (2006.01) |
| ***C10K 1/14*** | (2006.01) |
| ***C10K 1/16*** | (2006.01) |
| ***C10K 3/02*** | (2006.01) |
| ***C10L 3/08*** | (2006.01) |
| ***C10L 3/10*** | (2006.01) |

(52) U.S. Cl.

CPC ..... *C10K 1/101* (2013.01); *C10K 1/122* (2013.01); *C10K 1/143* (2013.01); *C10K 1/16* (2013.01); *C10K 1/165* (2013.01); *C10K 3/02* (2013.01); *C10L 3/08* (2013.01); *C10L 3/102* (2013.01); *C10J 2300/0903* (2013.01); *C10J 2300/093* (2013.01); *C10J 2300/094* (2013.01); *C10J 2300/0943* (2013.01); *C10J 2300/0959* (2013.01); *C10J 2300/0973* (2013.01); *C10J 2300/0986* (2013.01); *C10J 2300/1807* (2013.01); *C10J 2300/1823* (2013.01); *C10J 2300/1846* (2013.01); *C10J 2300/1853* (2013.01); *C10J 2300/1884* (2013.01)

(56) References Cited

U.S. PATENT DOCUMENTS

| | | | |
|---|---|---|---|
| 2,791,549 | A | 5/1957 | Jahnig |
| 2,813,126 | A | 11/1957 | Tierney |
| 2,840,462 | A | 6/1958 | Gorin |
| 2,860,959 | A | 11/1958 | Pettyjohn et al. |
| 2,886,405 | A | 5/1959 | Benson et al. |
| 3,034,848 | A | 5/1962 | King |
| 3,114,930 | A | 12/1963 | Oldham et al. |
| 3,150,716 | A | 9/1964 | Strelzoff et al. |
| 3,164,330 | A | 1/1965 | Neidl |
| 3,194,644 | A | 7/1965 | Gorin et al. |
| 3,351,563 | A | 11/1967 | Negra et al. |
| 3,435,590 | A | 4/1969 | Smith |
| 3,531,917 | A | 10/1970 | Grunewald et al. |
| 3,544,291 | A | 12/1970 | Schlinger et al. |
| 3,594,985 | A | 7/1971 | Ameen et al. |
| 3,615,300 | A | 10/1971 | Holm et al. |
| 3,689,240 | A | 9/1972 | Aldridge et al. |
| 3,740,193 | A | 6/1973 | Aldridge et al. |
| 3,746,522 | A | 7/1973 | Donath |
| 3,759,036 | A | 9/1973 | White |
| 3,779,725 | A | 12/1973 | Hegarty et al. |
| 3,814,725 | A | 6/1974 | Zimmerman et al. |
| 3,817,725 | A | 6/1974 | Sieg et al. |
| 3,828,474 | A | 8/1974 | Quartulli |
| 3,833,327 | A | 9/1974 | Pitzer et al. |
| 3,847,567 | A | 11/1974 | Kalina et al. |
| 3,876,393 | A | 4/1975 | Kasai et al. |
| 3,904,386 | A | 9/1975 | Graboski et al. |
| 3,915,670 | A | 10/1975 | Lacey et al. |
| 3,920,229 | A | 11/1975 | Piggott |
| 3,926,584 | A | 12/1975 | Adsetts |
| 3,929,431 | A | 12/1975 | Koh et al. |
| 3,958,957 | A | 5/1976 | Koh et al. |
| 3,966,875 | A | 6/1976 | Bratzler et al. |
| 3,969,089 | A | 7/1976 | Moss et al. |
| 3,971,639 | A | 7/1976 | Matthews |
| 3,972,693 | A | 8/1976 | Wiesner et al. |
| 3,975,168 | A | 8/1976 | Gorbaty |
| 3,985,519 | A | 10/1976 | Kalina et al. |
| 3,989,811 | A | 11/1976 | Hill |
| 3,996,014 | A | 12/1976 | Muller et al. |
| 3,998,607 | A | 12/1976 | Wesselhoft et al. |
| 3,999,607 | A | 12/1976 | Pennington et al. |
| 4,005,996 | A | 2/1977 | Hausberger et al. |
| 4,011,066 | A | 3/1977 | Bratzler et al. |
| 4,017,272 | A | 4/1977 | Anwer et al. |
| 4,021,370 | A | 5/1977 | Harris et al. |
| 4,025,423 | A | 5/1977 | Stonner et al. |
| 4,044,098 | A | 8/1977 | Miller et al. |
| 4,046,523 | A | 9/1977 | Kalina et al. |
| 4,052,176 | A | 10/1977 | Child et al. |
| 4,053,554 | A | 10/1977 | Reed et al. |
| 4,057,512 | A | 11/1977 | Vadovic et al. |
| 4,069,304 | A | 1/1978 | Starkovich et al. |
| 4,077,778 | A | 3/1978 | Nahas et al. |
| 4,091,073 | A | 5/1978 | Winkler |
| 4,092,125 | A | 5/1978 | Stambaugh et al. |
| 4,094,650 | A | 6/1978 | Koh et al. |
| 4,100,256 | A | 7/1978 | Bozzelli et al. |
| 4,101,449 | A | 7/1978 | Noda et al. |
| 4,104,201 | A | 8/1978 | Banks et al. |
| 4,113,615 | A | 9/1978 | Gorbaty |
| 4,116,996 | A | 9/1978 | Huang |
| 4,118,204 | A | 10/1978 | Eakman et al. |
| 4,152,119 | A | 5/1979 | Schulz |
| 4,157,246 | A | 6/1979 | Eakman et al. |
| 4,159,195 | A | 6/1979 | Clavenna |
| 4,162,902 | A | 7/1979 | Wiesner et al. |
| 4,173,465 | A | 11/1979 | Meissner et al. |
| 4,189,307 | A | 2/1980 | Marion |
| 4,193,771 | A | 3/1980 | Sharp et al. |
| 4,193,772 | A | 3/1980 | Sharp |
| 4,200,439 | A | 4/1980 | Lang |
| 4,204,843 | A | 5/1980 | Neavel |
| 4,211,538 | A | 7/1980 | Eakman et al. |
| 4,211,669 | A | 7/1980 | Eakman et al. |
| 4,219,338 | A | 8/1980 | Wolfs et al. |
| 4,223,728 | A | 9/1980 | Pegg |
| 4,225,457 | A | 9/1980 | Schulz |
| 4,235,044 | A | 11/1980 | Cheung |
| 4,243,639 | A | 1/1981 | Haas et al. |
| 4,249,471 | A | 2/1981 | Gunnerman |
| 4,252,771 | A | 2/1981 | Lagana et al. |
| 4,260,421 | A | 4/1981 | Brown et al. |
| 4,265,868 | A | 5/1981 | Kamody |
| 4,270,937 | A | 6/1981 | Adler et al. |
| 4,284,416 | A | 8/1981 | Nahas |
| 4,292,048 | A | 9/1981 | Wesselhoft et al. |
| 4,298,584 | A | 11/1981 | Makrides |
| 4,315,753 | A | 2/1982 | Bruckenstein et al. |
| 4,315,758 | A | 2/1982 | Patel et al. |
| 4,318,712 | A | 3/1982 | Lang et al. |
| 4,322,222 | A | 3/1982 | Sass |
| 4,330,305 | A | 5/1982 | Kuessner et al. |
| 4,331,451 | A | 5/1982 | Isogaya et al. |
| 4,334,893 | A | 6/1982 | Lang |
| 4,336,034 | A | 6/1982 | Lang et al. |
| 4,336,233 | A | 6/1982 | Appl et al. |
| 4,341,531 | A | 7/1982 | Duranleau et al. |
| 4,344,486 | A | 8/1982 | Parrish |
| 4,347,063 | A | 8/1982 | Sherwood et al. |
| 4,348,486 | A | 9/1982 | Calvin et al. |
| 4,348,487 | A | 9/1982 | Calvin et al. |
| 4,353,713 | A | 10/1982 | Cheng |
| 4,365,975 | A | 12/1982 | Williams et al. |
| 4,372,755 | A | 2/1983 | Tolman et al. |
| 4,375,362 | A | 3/1983 | Moss |
| 4,385,905 | A | 5/1983 | Tucker |
| 4,397,656 | A | 8/1983 | Ketkar |
| 4,400,182 | A | 8/1983 | Davies et al. |
| 4,407,206 | A | 10/1983 | Bartok et al. |
| 4,428,535 | A | 1/1984 | Venetucci |
| 4,432,773 | A | 2/1984 | Euker, Jr. et al. |
| 4,433,065 | A | 2/1984 | Van Der Burgt et al. |
| 4,436,028 | A | 3/1984 | Wilder |
| 4,436,531 | A | 3/1984 | Estabrook et al. |
| 4,439,210 | A | 3/1984 | Lancet |
| 4,443,415 | A | 4/1984 | Queneau et al. |
| 4,444,568 | A | 4/1984 | Beisswenger et al. |
| 4,459,138 | A | 7/1984 | Soung |
| 4,462,814 | A | 7/1984 | Holmes et al. |
| 4,466,828 | A | 8/1984 | Tamai et al. |
| 4,468,231 | A | 8/1984 | Bartok et al. |
| 4,478,425 | A | 10/1984 | Benko |

(56) References Cited

U.S. PATENT DOCUMENTS 4,478,725 A 10/1984 Velling et al.
4,482,529 A 11/1984 Chen et al.
4,491,609 A 1/1985 Degel et al.
4,497,784 A 2/1985 Diaz
4,500,323 A 2/1985 Siegfried et al.
4,505,881 A 3/1985 Diaz
4,508,544 A 4/1985 Moss
4,508,693 A 4/1985 Diaz
4,515,604 A 5/1985 Eisenlohr et al.
4,515,764 A 5/1985 Diaz
4,524,050 A 6/1985 Chen et al.
4,540,681 A 9/1985 Kustes et al.
4,541,841 A 9/1985 Reinhardt
4,551,155 A 11/1985 Wood et al.
4,558,027 A 12/1985 McKee et al.
4,572,826 A 2/1986 Moore
4,594,140 A 6/1986 Cheng
4,597,775 A 7/1986 Billimoria et al.
4,597,776 A 7/1986 Ullman et al.
4,604,105 A 8/1986 Aquino et al.
4,609,388 A 9/1986 Adler et al.
4,609,456 A 9/1986 Deschamps et al.
4,617,027 A 10/1986 Lang
4,619,864 A 10/1986 Hendrix et al.
4,620,421 A 11/1986 Brown et al.
4,661,237 A 4/1987 Kimura et al.
4,668,428 A 5/1987 Najjar
4,668,429 A 5/1987 Najjar
4,675,035 A 6/1987 Apffel
4,678,480 A 7/1987 Heinrich et al.
4,682,986 A 7/1987 Lee et al.
4,690,814 A 9/1987 Velenyi et al.
4,696,678 A 9/1987 Koyama et al.
4,699,632 A 10/1987 Babu et al.
4,704,136 A 11/1987 Weston et al.
4,720,289 A 1/1988 Vaugh et al.
4,747,938 A 5/1988 Khan
4,781,731 A 11/1988 Schlinger
4,803,061 A 2/1989 Najjar et al.
4,808,194 A 2/1989 Najjar et al.
4,810,475 A 3/1989 Chu et al.
4,822,935 A 4/1989 Scott
4,848,983 A 7/1989 Tomita et al.
4,854,944 A 8/1989 Strong
4,861,346 A 8/1989 Najjar et al.
4,861,360 A 8/1989 Apffel
4,872,886 A 10/1989 Henley et al.
4,876,080 A 10/1989 Paulson
4,892,567 A 1/1990 Yan
4,960,450 A 10/1990 Schwarz et al.
4,995,193 A 2/1991 Soga et al.
5,017,282 A 5/1991 Delbianco et al.
5,055,181 A 10/1991 Maa et al.
5,057,294 A 10/1991 Sheth et al.
5,059,406 A 10/1991 Sheth et al.
5,074,357 A 12/1991 Haines
5,093,094 A 3/1992 Van Kleeck et al.
5,094,737 A 3/1992 Bearden, Jr. et al.
5,132,007 A 7/1992 Meyer et al.
5,223,173 A 6/1993 Jeffrey
5,225,044 A 7/1993 Breu
5,236,557 A 8/1993 Muller et al.
5,250,083 A 10/1993 Wolfenbarger et al.
5,277,884 A 1/1994 Shinnar et al.
5,388,645 A 2/1995 Puri et al.
5,388,650 A 2/1995 Michael
5,435,940 A 7/1995 Doering et al.
5,536,893 A 7/1996 Gudmundsson
5,566,755 A 10/1996 Seidle et al.
5,616,154 A 4/1997 Elliott et al.
5,630,854 A 5/1997 Sealock, Jr. et al.
5,641,327 A 6/1997 Leas
5,660,807 A 8/1997 Forg et al.
5,669,960 A 9/1997 Couche
5,670,122 A 9/1997 Zamansky et al.
5,720,785 A 2/1998 Baker
5,733,515 A 3/1998 Doughty et al.
5,769,165 A 6/1998 Bross et al.
5,776,212 A 7/1998 Leas
5,785,721 A 7/1998 Brooker
5,788,724 A 8/1998 Carugati et al.
5,855,631 A 1/1999 Leas
5,865,898 A 2/1999 Holtzapple et al.
5,968,465 A 10/1999 Koveal et al.
6,013,158 A 1/2000 Wootten
6,015,104 A 1/2000 Rich, Jr.
6,028,234 A 2/2000 Heinemann et al.
6,032,737 A 3/2000 Brady et al.
6,090,356 A 7/2000 Jahnke et al.
6,119,778 A 9/2000 Seidle et al.
6,132,478 A 10/2000 Tsurui et al.
6,180,843 B1 1/2001 Heinemann et al.
6,187,465 B1 2/2001 Galloway
6,379,645 B1 4/2002 Bucci et al.
6,389,820 B1 5/2002 Rogers et al.
6,419,888 B1 7/2002 Wyckoff
6,506,349 B1 1/2003 Khanmamedov
6,506,361 B1 1/2003 Machado et al.
6,602,326 B2 8/2003 Lee et al.
6,641,625 B1 11/2003 Clawson et al.
6,653,516 B1 11/2003 Yoshikawa et al.
6,692,711 B1 2/2004 Alexion et al.
6,790,430 B1 9/2004 Lackner et al.
6,797,253 B2 9/2004 Lyon
6,808,543 B2 10/2004 Paisley
6,830,597 B1 12/2004 Green
6,855,852 B1 2/2005 Jackson et al.
6,878,358 B2 4/2005 Vosteen et al.
6,894,183 B2 5/2005 Choudhary et al.
6,955,595 B2 10/2005 Kim
6,955,695 B2 10/2005 Nahas
6,969,494 B2 11/2005 Herbst
7,074,373 B1 7/2006 Warren et al.
7,077,202 B2 7/2006 Shaw et al.
7,100,692 B2 9/2006 Parsley et al.
7,118,720 B1 10/2006 Mendelsohn et al.
7,132,183 B2 11/2006 Galloway
7,168,488 B2 1/2007 Olsvik et al.
7,205,448 B2 4/2007 Gajda et al.
7,220,502 B2 5/2007 Galloway
7,299,868 B2 11/2007 Zapadinski
7,309,383 B2 12/2007 Beech, Jr. et al.
7,481,275 B2 1/2009 Olsvik et al.
7,666,383 B2 2/2010 Green
7,677,309 B2 3/2010 Shaw et al.
7,758,663 B2 7/2010 Rabovitser et al.
7,897,126 B2 3/2011 Rappas et al.
7,901,644 B2 3/2011 Rappas et al.
7,922,782 B2 4/2011 Sheth
7,926,750 B2 4/2011 Hauserman
7,976,593 B2 7/2011 Graham
8,114,176 B2 2/2012 Nahas
8,114,177 B2 2/2012 Hippo et al.
8,123,827 B2 2/2012 Robinson
8,163,048 B2 4/2012 Rappas et al.
8,192,716 B2 6/2012 Raman et al.
8,202,913 B2 6/2012 Robinson et al.
8,268,899 B2 9/2012 Robinson et al.
8,286,901 B2 10/2012 Rappas et al.
8,297,542 B2 10/2012 Rappas et al.
8,328,890 B2 12/2012 Reiling et al.
8,349,037 B2 1/2013 Steiner et al.
8,349,039 B2 1/2013 Robinson
8,361,428 B2 1/2013 Raman et al.
8,366,795 B2 2/2013 Raman et al.
8,479,833 B2 7/2013 Raman
8,479,834 B2 7/2013 Preston
8,502,007 B2 8/2013 Hippo et al.
2002/0036086 A1 3/2002 Minkkinen et al.
2003/0070808 A1 4/2003 Allison
2003/0131582 A1 7/2003 Anderson et al.
2003/0167691 A1 9/2003 Nahas
2004/0020123 A1 2/2004 Kimura et al.
2004/0023086 A1 2/2004 Su et al.

(56) References Cited

U.S. PATENT DOCUMENTS

| | | | |
|---|---|---|---|
| 2004/0123601 | A1 | 7/2004 | Fan |
| 2004/0180971 | A1 | 9/2004 | Inoue et al. |
| 2004/0256116 | A1 | 12/2004 | Olsvik et al. |
| 2005/0107648 | A1 | 5/2005 | Kimura et al. |
| 2005/0137442 | A1 | 6/2005 | Gajda et al. |
| 2005/0192362 | A1 | 9/2005 | Rodriguez et al. |
| 2005/0287056 | A1 | 12/2005 | Baker et al. |
| 2005/0288537 | A1 | 12/2005 | Maund et al. |
| 2006/0149423 | A1 | 7/2006 | Barnicki et al. |
| 2006/0228290 | A1 | 10/2006 | Green |
| 2006/0231252 | A1 | 10/2006 | Shaw et al. |
| 2006/0265953 | A1 | 11/2006 | Hobbs |
| 2006/0272813 | A1 | 12/2006 | Olsvik et al. |
| 2007/0000177 | A1 | 1/2007 | Hippo et al. |
| 2007/0051043 | A1 | 3/2007 | Schingnitz |
| 2007/0083072 | A1 | 4/2007 | Nahas |
| 2007/0180990 | A1 | 8/2007 | Downs et al. |
| 2007/0186472 | A1 | 8/2007 | Rabovitser et al. |
| 2007/0220810 | A1 | 9/2007 | Leveson et al. |
| 2007/0227729 | A1 | 10/2007 | Zubrin et al. |
| 2007/0237696 | A1 | 10/2007 | Payton |
| 2007/0277437 | A1 | 12/2007 | Sheth |
| 2007/0282018 | A1 | 12/2007 | Jenkins |
| 2008/0141591 | A1 | 6/2008 | Kohl |
| 2008/0289822 | A1 | 11/2008 | Betzer Tsilevich |
| 2009/0012188 | A1 | 1/2009 | Rojey et al. |
| 2009/0048476 | A1 | 2/2009 | Rappas et al. |
| 2009/0090055 | A1 | 4/2009 | Ohtsuka |
| 2009/0090056 | A1 | 4/2009 | Ohtsuka |
| 2009/0165361 | A1 | 7/2009 | Rappas et al. |
| 2009/0165376 | A1 | 7/2009 | Lau et al. |
| 2009/0165379 | A1 | 7/2009 | Rappas |
| 2009/0165380 | A1 | 7/2009 | Lau et al. |
| 2009/0165381 | A1 | 7/2009 | Robinson |
| 2009/0165382 | A1 | 7/2009 | Rappas et al. |
| 2009/0165383 | A1 | 7/2009 | Rappas et al. |
| 2009/0165384 | A1 | 7/2009 | Lau et al. |
| 2009/0166588 | A1 | 7/2009 | Spitz et al. |
| 2009/0169448 | A1 | 7/2009 | Rappas et al. |
| 2009/0169449 | A1 | 7/2009 | Rappas et al. |
| 2009/0170968 | A1 | 7/2009 | Nahas et al. |
| 2009/0173079 | A1 | 7/2009 | Wallace et al. |
| 2009/0217575 | A1 | 9/2009 | Raman et al. |
| 2009/0217582 | A1 | 9/2009 | May et al. |
| 2009/0217584 | A1 | 9/2009 | Raman et al. |
| 2009/0217585 | A1 | 9/2009 | Raman et al. |
| 2009/0217586 | A1 | 9/2009 | Rappas et al. |
| 2009/0217587 | A1 | 9/2009 | Raman et al. |
| 2009/0217588 | A1 | 9/2009 | Hippo et al. |
| 2009/0217589 | A1 | 9/2009 | Robinson |
| 2009/0217590 | A1 | 9/2009 | Rappas et al. |
| 2009/0218424 | A1 | 9/2009 | Hauserman |
| 2009/0220406 | A1 | 9/2009 | Rahman |
| 2009/0229182 | A1 | 9/2009 | Raman et al. |
| 2009/0235585 | A1 | 9/2009 | Neels et al. |
| 2009/0236093 | A1 | 9/2009 | Zubrin et al. |
| 2009/0246120 | A1 | 10/2009 | Raman et al. |
| 2009/0259080 | A1 | 10/2009 | Raman et al. |
| 2009/0260287 | A1 | 10/2009 | Lau |
| 2009/0305093 | A1 | 12/2009 | Biollaz et al. |
| 2009/0324458 | A1 | 12/2009 | Robinson et al. |
| 2009/0324459 | A1 | 12/2009 | Robinson et al. |
| 2009/0324460 | A1 | 12/2009 | Robinson et al. |
| 2009/0324461 | A1 | 12/2009 | Robinson et al. |
| 2009/0324462 | A1 | 12/2009 | Robinson et al. |
| 2010/0018113 | A1 | 1/2010 | Bohlig et al. |
| 2010/0050654 | A1 | 3/2010 | Chiu et al. |
| 2010/0071235 | A1 | 3/2010 | Pan et al. |
| 2010/0071262 | A1 | 3/2010 | Robinson et al. |
| 2010/0076235 | A1 | 3/2010 | Reiling et al. |
| 2010/0120926 | A1 | 5/2010 | Robinson et al. |
| 2010/0121125 | A1 | 5/2010 | Hippo et al. |
| 2010/0159352 | A1 | 6/2010 | Gelin et al. |
| 2010/0168494 | A1 | 7/2010 | Rappas et al. |
| 2010/0168495 | A1 | 7/2010 | Rappas et al. |
| 2010/0179232 | A1 | 7/2010 | Robinson et al. |
| 2010/0287835 | A1 | 11/2010 | Reiling et al. |
| 2010/0287836 | A1 | 11/2010 | Robinson et al. |
| 2010/0292350 | A1 | 11/2010 | Robinson et al. |
| 2011/0031439 | A1 | 2/2011 | Sirdeshpande et al. |
| 2011/0062012 | A1 | 3/2011 | Robinson |
| 2011/0062721 | A1 | 3/2011 | Sirdeshpande et al. |
| 2011/0062722 | A1 | 3/2011 | Sirdeshpande et al. |
| 2011/0064648 | A1 | 3/2011 | Preston et al. |
| 2011/0088896 | A1 | 4/2011 | Preston |
| 2011/0088897 | A1 | 4/2011 | Raman |
| 2011/0146978 | A1 | 6/2011 | Perlman |
| 2011/0146979 | A1 | 6/2011 | Wallace |
| 2011/0207002 | A1 | 8/2011 | Powell et al. |
| 2011/0217602 | A1 | 9/2011 | Sirdeshpande |
| 2011/0262323 | A1 | 10/2011 | Rappas et al. |
| 2011/0294905 | A1 | 12/2011 | Robinson et al. |
| 2012/0046510 | A1 | 2/2012 | Sirdeshpande |
| 2012/0060417 | A1 | 3/2012 | Raman et al. |
| 2012/0102836 | A1 | 5/2012 | Raman et al. |
| 2012/0102837 | A1 | 5/2012 | Raman et al. |
| 2012/0213680 | A1 | 8/2012 | Rappas et al. |
| 2012/0271072 | A1 | 10/2012 | Robinson et al. |
| 2012/0305848 | A1 | 12/2012 | Sirdeshpande |
| 2013/0042824 | A1 | 2/2013 | Sirdeshpande |
| 2013/0046124 | A1 | 2/2013 | Sirdeshpande |
| 2013/0172640 | A1 | 7/2013 | Robinson et al. |

FOREIGN PATENT DOCUMENTS

| | | |
|---|---|---|
| CA | 1041553 | 10/1978 |
| CA | 1106178 | 8/1981 |
| CA | 1 125 026 | 6/1982 |
| CA | 1187702 | 6/1985 |
| CA | 1282243 | 4/1991 |
| CA | 1299589 | 4/1992 |
| CA | 1332108 | 9/1994 |
| CA | 2673121 | 6/2008 |
| CA | 2713642 | 7/2009 |
| CN | 86101230 | 10/1986 |
| CN | 1477090 | 2/2004 |
| CN | 1916124 | 2/2007 |
| CN | 101045524 | 10/2007 |
| CN | 101074397 | 11/2007 |
| CN | 101555420 | 10/2009 |
| DE | 2 210 891 | 3/1972 |
| DE | 2210891 | 9/1972 |
| DE | 2852710 | 6/1980 |
| DE | 3422202 | 12/1985 |
| DE | 10061607 | 6/2002 |
| EP | 0024792 | 3/1981 |
| EP | 0 067 580 | 12/1982 |
| EP | 0102828 | 3/1984 |
| EP | 0 138 463 | 4/1985 |
| EP | 0 225 146 | 6/1987 |
| EP | 0 259 927 | 3/1988 |
| EP | 0473153 | 3/1992 |
| EP | 0 723 930 | 7/1996 |
| EP | 819 | 4/2000 |
| EP | 1001002 | 5/2000 |
| EP | 1004746 | 5/2000 |
| EP | 1136542 | 9/2001 |
| EP | 1 207 132 | 5/2002 |
| EP | 1 741 673 | 6/2006 |
| EP | 1768207 | 3/2007 |
| EP | 2058471 | 5/2009 |
| FR | 797 089 | 4/1936 |
| FR | 2 478 615 | 9/1981 |
| FR | 2906879 | 4/2008 |
| GB | 593910 | 10/1947 |
| GB | 640907 | 8/1950 |
| GB | 676615 | 7/1952 |
| GB | 701 131 | 12/1953 |
| GB | 760627 | 11/1956 |
| GB | 798741 | 7/1958 |
| GB | 820 257 | 9/1959 |
| GB | 996327 | 6/1965 |
| GB | 1033764 | 6/1966 |
| GB | 1448562 | 9/1976 |

(56) References Cited

FOREIGN PATENT DOCUMENTS

| | | |
|---|---|---|
| GB | 1453081 | 10/1976 |
| GB | 1467219 | 3/1977 |
| GB | 1467995 | 3/1977 |
| GB | 1 599 932 | 7/1977 |
| GB | 1560873 | 2/1980 |
| GB | 2078251 | 1/1982 |
| GB | 2154600 | 9/1985 |
| GB | 2455864 | 6/2009 |
| JP | 53094305 | 8/1978 |
| JP | 53111302 | 9/1978 |
| JP | 54020003 | 2/1979 |
| JP | 54150402 | 11/1979 |
| JP | 55012181 | 1/1980 |
| JP | 56145982 | 11/1981 |
| JP | 56157493 | 12/1981 |
| JP | 60-35092 | 2/1985 |
| JP | 60077938 | 5/1985 |
| JP | 62241991 | 10/1987 |
| JP | 62 257985 | 11/1987 |
| JP | 63095292 | 4/1988 |
| JP | 03-115491 | 5/1991 |
| JP | 2000290659 | 10/2000 |
| JP | 2000290670 | 10/2000 |
| JP | 2002105467 | 4/2002 |
| JP | 2004292200 | 10/2004 |
| JP | 2004298818 | 10/2004 |
| JP | 2006 169476 | 6/2006 |
| WO | 00/18681 | 4/2000 |
| WO | 00/43468 | 7/2000 |
| WO | 02/40768 | 5/2002 |
| WO | 02/079355 | 10/2002 |
| WO | 02/103157 | 12/2002 |
| WO | 03/018958 | 3/2003 |
| WO | 03/033624 | 4/2003 |
| WO | 2004/055323 | 7/2004 |
| WO | 2004/072210 | 8/2004 |
| WO | 2006/031011 | 3/2006 |
| WO | 2007/004342 | 1/2007 |
| WO | 2007/005284 | 1/2007 |
| WO | 2007/047210 | 4/2007 |
| WO | 2007/068682 | 6/2007 |
| WO | 2007/076363 | 7/2007 |
| WO | 2007/077137 | 7/2007 |
| WO | 2007/077138 | 7/2007 |
| WO | 2007/083072 | 7/2007 |
| WO | 2007/128370 | 11/2007 |
| WO | 2007/143376 | 12/2007 |
| WO | 2008/058636 | 5/2008 |
| WO | 2008/073889 | 6/2008 |
| WO | 2008/087154 | 7/2008 |
| WO | 2009/018053 | 2/2009 |
| WO | 2009/048723 | 4/2009 |
| WO | 2009/048724 | 4/2009 |
| WO | 2009/086361 | 7/2009 |
| WO | 2009/086362 | 7/2009 |
| WO | 2009/086363 | 7/2009 |
| WO | 2009/086366 | 7/2009 |
| WO | 2009/086367 | 7/2009 |
| WO | 2009/086370 | 7/2009 |
| WO | 2009/086372 | 7/2009 |
| WO | 2009/086374 | 7/2009 |
| WO | 2009/086377 | 7/2009 |
| WO | 2009/086383 | 7/2009 |
| WO | 2009/086407 | 7/2009 |
| WO | 2009/086408 | 7/2009 |
| WO | 2009/111330 | 9/2009 |
| WO | 2009/111331 | 9/2009 |
| WO | 2009/111332 | 9/2009 |
| WO | 2009/111335 | 9/2009 |
| WO | 2009/111342 | 9/2009 |
| WO | 2009/111345 | 9/2009 |
| WO | 2009/124017 | 10/2009 |
| WO | 2009/124019 | 10/2009 |
| WO | 2009/158576 | 12/2009 |
| WO | 2009/158579 | 12/2009 |
| WO | 2009/158580 | 12/2009 |
| WO | 2009/158582 | 12/2009 |
| WO | 2009/158583 | 12/2009 |
| WO | 2010/033846 | 3/2010 |
| WO | 2010/033848 | 3/2010 |
| WO | 2010/033850 | 3/2010 |
| WO | 2010/033852 | 3/2010 |
| WO | 2010/048493 | 4/2010 |
| WO | 2010/078297 | 7/2010 |
| WO | 2010/078298 | 7/2010 |
| WO | 2010/132549 | 11/2010 |
| WO | 2010/132551 | 11/2010 |
| WO | 2011/017630 | 2/2011 |
| WO | 2011/029278 | 3/2011 |
| WO | 2011/029282 | 3/2011 |
| WO | 2011/029283 | 3/2011 |
| WO | 2011/029284 | 3/2011 |
| WO | 2011/029285 | 3/2011 |
| WO | 2011/034888 | 3/2011 |
| WO | 2011/034889 | 3/2011 |
| WO | 2011/034890 | 3/2011 |
| WO | 2011/034891 | 3/2011 |
| WO | 2011/049858 | 4/2011 |
| WO | 2011/049861 | 4/2011 |
| WO | 2011/063608 | 6/2011 |
| WO | 2011/084580 | 7/2011 |
| WO | 2011/084581 | 7/2011 |
| WO | 2011/106285 | 9/2011 |
| WO | 2011/139694 | 11/2011 |
| WO | 2011/150217 | 12/2011 |
| WO | 2012/024369 | 2/2012 |
| WO | 2012/033997 | 3/2012 |
| WO | 2012/061235 | 5/2012 |
| WO | 2012/061238 | 5/2012 |
| WO | 2012/116003 | 8/2012 |
| WO | 2012/145497 | 10/2012 |
| WO | 2012/166879 | 12/2012 |
| WO | 2013/025808 | 2/2013 |
| WO | 2013/025812 | 2/2013 |
| WO | 2013/052553 | 4/2013 |

OTHER PUBLICATIONS

U.S. Appl. No. 12/778,548, filed May 12, 2010, Robinson, et al.

U.S. Appl. No. 12/778,552, filed May 12, 2010, Robinson, et al.

Asami, K., et al., "Highly Active Iron Catalysts from Ferric Chloride or the Steam Gasification of Brown Coal," ind. Eng. Chem. Res., vol. 32, No. 8, 1993, pp. 1631-1636.

Berger, R. et al., "High Temperature $CO_2$-Absorption: A Process Offering New Prospects in Fuel Chemistry," The Fifth International Symposium on Coal Combustion, Nov. 2003, Nanjing, China, pp. 547-549.

Brown et al., "Biomass-Derived Hydrogen From a Thermally Ballasted Gasifier," Aug. 2005.

Brown et al., "Biomass-Derived Hydrogen From a Thermally Ballasted Gasifier," DOE Hydrogen Program Contractors' Review Metting, Center for Sustainable Environmental Technologies, Iowa State University, May 21, 2003.

Cohen, S.J., Project Manager, "Large Pilot Plant Alternatives for Scaleup of the Catalytic Coal Gasification Process," FE-2480-20, U.S. Dept. of Energy, Contract No. EX-76-C-01-2480, 1979.

Euker, Jr., C.A., Reitz, R.A., Program Managers, "Exxon Catalytic Coal-Gasification-Process Development Program," Exxon Research & Engineering Company, FE-2777-31, U.S. Dept. of Energy, Contract No. ET-78-C-01-2777, 1981.

Kalina, T., Nahas, N.C., Project Managers, "Exxon Catalaytic Coal Gasification Process Predevelopment Program," Exxon Research & Engineering Company, FE-2369-24, U.S. Dept. of Energy, Contract No. E(49-18)-2369, 1978.

Nahas, N.C., "Exxon Catalytic Coal Gasification Process—Fundamentals to Flowsheets," Fuel, vol. 62, No. 2, 1983, pp. 239-241.

Ohtsuka, Y. et al., "Highly Active Catalysts from Inexpensive Raw Materials for Coal Gasification," Catalysis Today, vol. 39, 1997, pp. 111-125.

Ohtsuka, Yasuo et al, "Steam Gasification of Low-Rank Coals with a Chlorine-Free Iron Catalyst from Ferric Chloride," Ind. Eng. Chem. Res., vol. 30, No. 8, 1991, pp. 1921-1926.

(56) References Cited

OTHER PUBLICATIONS

Ohtsuka, Yasuo et al., "Calcium Catalysed Steam Gasification of Yalourn Brown Coal," Fuel, vol. 65, 1986, pp. 1653-1657.
Ohtsuka, Yasuo, et al, "Iron-Catalyzed Gasification of Brown Coal at Low Temperatures," Energy & Fuels, vol. 1, No. 1, 1987, pp. 32-36.
Ohtsuka, Yasuo, et al., "Ion-Exchanged Calcium From Calcium Carbonate and Low-Rank Coals: High Catalytic • Activity in Steam Gasification," Energy & Fuels 1996, 10, pp. 431-435.
Ohtsuka, Yasuo et al., "Steam Gasification of Coals with Calcium Hydroxide," Energy & Fuels, vol. 9, No. 6, 1995, pp. 1038-1042.
Pereira, P., et al., "Catalytic Steam Gasification of Coals," Energy & Fuels, vol. 6, No. 4, 1992, pp. 407-410.
Ruan Xiang-Quan, et al., "Effects of Catalysis on Gasification of Tatong Coal Char," Fuel, vol. 66, Apr. 1987, pp. 568-571.
Tandon, D., "Low Temperature and Elevated Pressure Steam Gasification of Illinois Coal," College of Engineering in the Graduate School, Southern Illinois university at Carbondale, Jun. 1996.
Adsorption, http://en.wikipedia.org/wiki/Adsorption, pp. 1-8 (Oct. 17, 2007).
Amine gas treating, http://en.wikipedia.org/wiki/Acid_gas_removal, pp. 1-4 (Oct. 21, 2007).
Coal, http://en.wikipedia.org/wiki/Coal_gasification, pp. 1-8 (Oct. 29, 2007).
Coal Data: A Reference, Energy Information Administration, Office of Coal, Nuclear, Electric, and Alternate Fuels U.S. Department of Energy, DOE/EIA-0064(93), Feb. 1995.
Deepak Tandon, Dissertation Approval, "Low Temperature and Elevated Pressure Steam Gasification of Illinois Coal", Jun. 13, 1996.
Demibras, "Demineralization of Agricultural Residues by Water Leaching", *Energy Sources*, vol. 25, pp. 679-687, (2003).
Fluidized Bed Gasifiers, http://www.energyproducts.com/fluidized_bed_gasifiers.htm, Oct. 2007, pp. 1-5.
Gas separation, http://en.wikipedia.org/wiki/Gas_separation, pp. 1-2 (Feb. 24, 2007).
Gasification, http://en.wikipedia.org/wiki/Gasification, pp. 1-6 (Oct. 29, 2007).
Gallagher Jr., et al., "Catalytic Coal Gasification for SNG Manufacture", *Energy Research*, vol. 4, pp. 137-147, (1980).
Heinemann, et al., "Fundamental and Exploratory Studies of Catalytic Steam Gasification of Carbonaceous Materials", Final Report Fiscal Years 1985-1994.
Jensen, et al. Removal of K and C1 by leaching of straw char, *Biomass and Bioenergy*, vol. 20, pp. 447-457, (2001).
Mengjie, et al., "A potential renewable energy resource development and utilization of biomass energy", http://www.fao.org.docrep/T4470E/t4470e0n.htm, pp. 1-8 (1994).
Meyers, et al. Fly Ash as a Construction Material for Highways, A Manual. Federal Highway Administration, Report No. FHWA-IP-76-16, Washington, DC, 1976.
Moulton, Lyle K. "Bottom Ash and Boiler Slag", *Proceedings of the Third International Ash Utilization Symposium*, U.S. Bureau of Mines, Information Circular No. 8640, Washington, DC, 1973.
Natural gas processing, http://en.wikipedia.org/wiki/Natural_gas_processing, pp. 1-4 (Oct. 22, 2007).
Natural Gas Processing: The Crucial Link Between Natural Gas Production and Its Transportation to Market. Energy Information Administration, Office of Oil and Gas; pp. 1-11, (2006).
Prins, et al., "Exergetic optimisation of a production process of Fischer-Tropsch fuels from biomass", *Fuel Processing Technology*, vol. 86, pp. 375-389, (2004).
Reboiler, http://en.wikipedia.org/wiki/Reboiler, pp. 1-4 (Nov. 11, 2007).
What is XPS?, http://www.nuance.northwestern.edu/KeckII/xps1.asp, 2006, pp. 1-2 (2006).
2.3 Types of gasifiers, http://www.fao.org/docrep/t0512e/T0512e0a.htm, pp. 1-6 (1986).
2.4 Gasification fuels, http://www.fao.org/docrep/t0512e/T0512e0b.htm#TopofPage, pp. 1-8 (1986).
2.5 Design of downdraught gasifiers, http://www.fao.org/docrep/t0512e/T0512e0c.htm#TopOfPage, pp. 1-8 (1986).
2.6 Gas cleaning and cooling, http://www.fao.org/docrep/t0512e0d.htm#TopOFPage, pp. 1-3 (1986).
A.G. Collot et al., "Co-pyrolysis and co-gasification of coal and biomass in bench-scale fixed-bed and fluidized bed reactors", (1999) Fuel 78, pp. 667-679.
Wenkui Zhu et al., "Catalytic gasification of char from co-pyrolysis of coal and biomass", (2008) Fuel Processing Technology, vol. 89, pp. 890-896.
Chiesa P. et al., "Co-Production of hydrogen, electricity and C02 from coal with commercially ready technology. Part A: Performance and emissions", (2005) International Journal of Hydrogen Energy, vol. 30, No. 7, pp. 747-767.
Chiaramonte et al, "Upgrade Coke by Gasification", (1982) Hydrocarbon Processing, vol. 61 (9), pp. 255-257 (Abstract only).
Gerdes, Kristin, et al., "Integrated Gasification Fuel Cell Performance and Cost Assessment," National Energy Technology Laboratory, U.S. Department of Energy, Mar. 27, 2009, pp. 1-26.
Ghosh, S., et al., "Energy Analysis of a Cogeneration Plant Using Coal Gasification and Solid Oxide Fuel Cell," Energy, 2006, vol. 31, No. 2-3, pp. 345-363.
Jeon, S.K., et al., "Characteristics of Steam Hydrogasification of Wood Using a Micro-Batch Reactor," Fuel, 2007, vol. 86, pp. 2817-2823.
Li, Mu, et al., "Design of Highly Efficient Coal-Based Integrated Gasification Fuel Cell Power Plants," Journal of Power Sources, 2010, vol. 195, pp. 5707-5718.
Prins, M.J., et al., "Exergetic Optimisation of a Production Process of Fischer-Tropsch Fuels from Biomass," Fuel Processing Technology, 2005, vol. 86, No. 4, pp. 375-389.
Hydromethanation Process, GreatPoint Energy, Inc., from World Wide Web <http://greatpointenergy.com/ourtechnology.php.> accessed Sep. 5, 2013.
Sigma-Aldrich "Particle Size Conversion Table" (2004); from World Wide Web <http:/www.sigmaaldrich.com/chemistry/learning-center/technical-library/particle-size-conversion.printerview.html>.
Coal Conversion Processes (Gasification), Encyclopedia of Chemical Technology, 4$^{th}$ Edition, vol. 6, pp. 541-566, (1993).
"Integrate Gasification Combined Cycle (IGCC)", WorleyParsons Resources & Energy, Accessed Feb. 24, 2006, http://www.worleyparsons.com/v5/page.aspx?id=164.

STEAM GENERATING SLURRY GASIFIER FOR THE CATALYTIC GASIFICATION OF A CARBONACEOUS FEEDSTOCK

CROSS-REFERENCE TO RELATED APPLICATIONS

This patent application is a continuation of U.S. application Ser. No. 12/343,149, filed on Dec. 23, 2008, which claims priority under 35 U.S.C. §119 from U.S. Provisional Application Ser. No. 61/017,321 (filed Dec. 28, 2007), the disclosure of which applications are hereby incorporated by reference herein for all purposes as if fully set forth in this application.

FIELD OF THE INVENTION

The present invention relates to a steam generating slurry gasifier which produces steam and synthesis gas from an aqueous carbonaceous feed slurry. Further, the invention relates to processes for preparation gaseous products, and in particular, methane via the catalytic gasification of carbonaceous feedstocks in the presence of steam and synthesis gas generated by the slurry gasifier.

BACKGROUND OF THE INVENTION

In view of numerous factors such as higher energy prices and environmental concerns, the production of value-added gaseous products from lower-fuel-value carbonaceous feedstocks, such as petroleum coke and coal, is receiving renewed attention. The catalytic gasification of such materials to produce methane and other value-added gases is disclosed, for example, in U.S. Pat. Nos. 3,828,474, 3,998,607, 4,057,512, 4,092,125, 4,094,650, 4,204,843, 4,468,231, 4,500,323, 4,541,841, 4,551,155, 4,558,027, 4,606,105, 4,617,027, 4,609,456, 5,017,282, 5,055,181, 6,187,465, 6,790,430, 6,894,183, 6,955,695, US2003/0167961A1, US2006/0265953A1, US2007/000177A1, US2007/083072A1, US2007/0277437A1 and GB1599932.

The process for the catalytic gasification of a carbonaceous material to synthetic natural gas requires the presence of steam to react with carbon either in the gas phase or on the surface of the carbonaceous material to generate methane and carbon dioxide. It has generally been contemplated to utilize coal-fired boilers to generate the required steam. Such methods have the disadvantages of requiring an additional fuel source for the boiler, while producing an exhaust comprising additional acid gases (e.g, carbon dioxide, sulfur dioxide, nitrous oxides), which must be treated and exhausted to the atmosphere or otherwise sequestered. As such, there exists a need in the art to develop apparatuses and processes for the catalytic gasification of carbonaceous materials to synthetic natural gas which more efficiently utilize fuels sources while decreasing the carbon footprint of the overall process.

SUMMARY OF THE INVENTION

In a first aspect, a gasifier apparatus is provided for producing a first plurality of gases comprising methane and one or more of hydrogen, carbon monoxide, carbon dioxide, hydrogen sulfide, ammonia and other higher hydrocarbons from a catalyzed carbonaceous feedstock, the gasifier apparatus comprising: a fluidized bed gasifier configured to receive the catalyzed carbonaceous feedstock and a second plurality of gases comprising steam, hydrogen and carbon monoxide, and to exhaust the first plurality of gases; and a slurry gasifier configured to supply to the fluidized bed gasifier the second plurality of gases, the slurry gasifier comprising, a gasifier chamber; a slurry conduit for supplying an aqueous carbonaceous slurry as a reactant to the gasifier chamber; an optional syngas conduit in communication with a syngas source and the gasifier chamber for optionally supplying a syngas to the gasifier chamber; an oxygen gas conduit for supplying enriched oxygen gas as a reactant to the fluidized bed gasifier chamber; and a heated gas conduit in communication with the fluidized bed gasifier for supplying the second plurality of gases from the slurry gasifier to the fluidized bed gasifier.

In a second aspect, a slurry gasifier is provided for generating a plurality of gases comprising steam, hydrogen and carbon monoxide from an aqueous carbonaceous slurry, the slurry gasifier comprising, a gasifier chamber; an optional syngas conduit in communication with a syngas source and the gasifier chamber for optionally supplying a syngas to the gasifier chamber; an oxygen gas conduit for supplying enriched oxygen gas as a reactant to the gasifier chamber; a slurry conduit for supplying an aqueous carbonaceous slurry as a reactant to the gasifier chamber; and a heated gas conduit for exhausting the plurality of gases.

In a third aspect, a process is provided for generating a plurality of gases comprising steam, hydrogen and carbon monoxide, from an aqueous carbonaceous slurry, the process comprising the steps of: (a) providing a slurry gasifier; (b) supplying the slurry gasifier with an aqueous carbonaceous slurry, an enriched oxygen gas, and optionally a syngas, the slurry comprising carbonaceous matter and water in a weight ratio of from about 5:95 to about 60:40; and (c) reacting the aqueous carbonaceous slurry in the slurry gasifier in the presence of oxygen and under suitable temperature and pressure so as to generate the plurality of gases.

In a fourth aspect, a process is provided for converting a carbonaceous material into a first plurality of gases comprising methane and one or more of hydrogen, carbon monoxide, carbon dioxide, hydrogen sulfide, ammonia and other higher hydrocarbons, the process comprising the steps of: providing a gasifier apparatus having a fluidized bed gasifier and a slurry gasifier according to the first aspect; supplying a particulate composition comprising a carbonaceous material and a gasification catalyst to the fluidized bed gasifier, wherein the gasification catalyst, in the presence of steam and under suitable temperature and pressure, exhibits gasification activity whereby the first plurality of gases is formed; supplying an aqueous carbonaceous slurry, enriched oxygen gas and optionally a syngas to the slurry gasifier; reacting the aqueous carbonaceous slurry in the slurry gasifier in the presence of oxygen and under suitable temperature and pressure so as to generate a second plurality of gases comprising steam, hydrogen and carbon monoxide; introducing the second plurality of gases into the fluidized bed gasifier; reacting the particulate composition in the fluidized bed gasifier in the presence of the second plurality of gases, and under suitable temperature and pressure, to form the first plurality of gases; and at least partially separating the first plurality of gases to produce a stream comprising a predominant amount of one of the gases in the first plurality of gases, wherein the gasification catalyst comprises a source of at least one alkali metal and is present in an amount sufficient to provide, in the particulate composition, a ratio of alkali metal atoms to carbon atoms ranging from about 0.01 to about 0.08; and the aqueous carbonaceous slurry comprises a mixture of carbonaceous material and water at a weight ratio ranging from about 5:95 to about 60:40.

DETAILED DESCRIPTION

Figure 1:
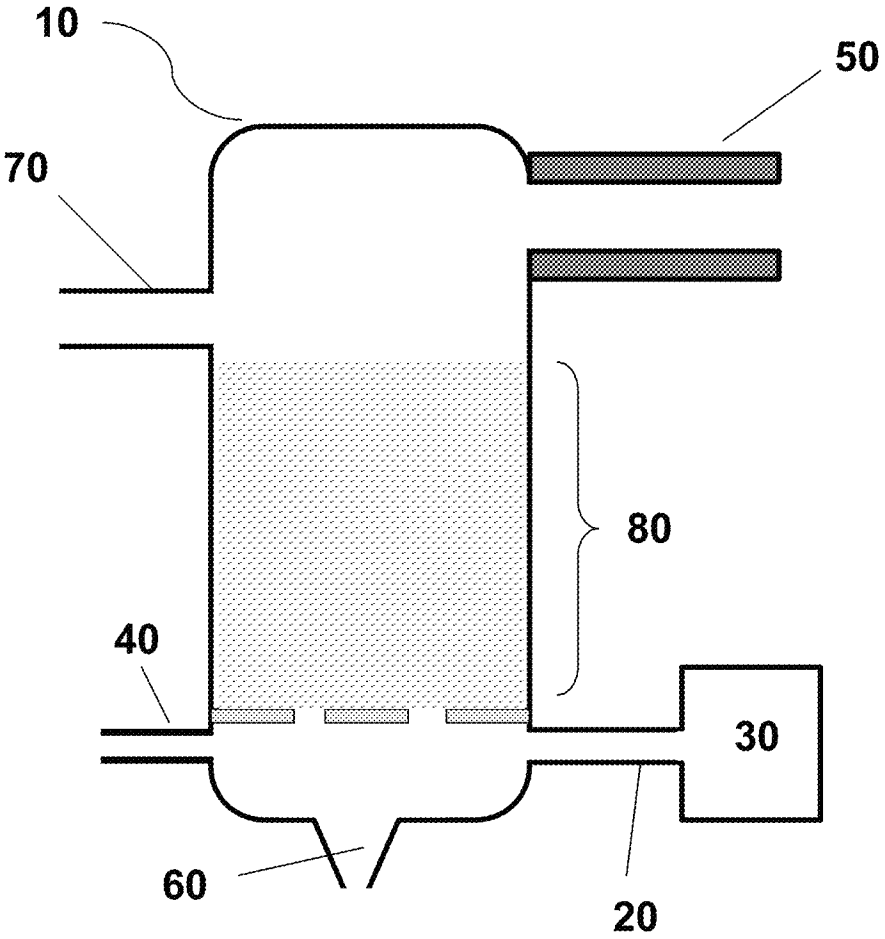
FIG. 1 is a schematic of an exemplary slurry gasifier of the invention.

The present invention relates to steam generating slurry gasifiers for proving high-pressure and high-temperature steam. The slurry gasifiers of the present invention are based on gasification reactors adapted for processing a slurry feedstock comprising at least 40% water. Such slurry gasifiers can be integrated into processes for the catalytic gasification of carbonaceous feedstock.

Recent developments to catalytic gasification technology are disclosed in commonly owned US2007/0000177A1, US2007/0083072A1 and US2007/0277437A1; and U.S. patent application Ser. No. 12/178,380 (filed 23 Jul. 2008), Ser. No. 12/234,012 (filed 19 Sep. 2008) and Ser. No. 12/234,018 (filed 19 Sep. 2008). Moreover, the processes of the present invention can be practiced in conjunction with the subject matter of the following U.S. Patent Applications, each of which was filed on even date herewith: Ser. No. 12/342,565, entitled "PETROLEUM COKE COMPOSITIONS FOR CATALYTIC GASIFICATION"; Ser. No. 12/342,554, entitled "CATALYTIC GASIFICATION PROCESS WITH RECOVERY OF ALKALI METAL FROM CHAR"; Ser. No. 12/342,608, entitled "PETROLEUM COKE COMPOSITIONS FOR CATALYTIC GASIFICATION"; Ser. No. 12/342,663, entitled "CARBONACEOUS FUELS AND PROCESSES FOR MAKING AND USING THEM"; Ser. No. 12/342,715, entitled "CATALYTIC GASIFICATION PROCESS WITH RECOVERY OF ALKALI METAL FROM CHAR"; Ser. No. 12/342,578, entitled "COAL COMPOSITIONS FOR CATALYTIC GASIFICATION"; Ser. No. 12/342,596, entitled "PROCESSES FOR MAKING SYNTHESIS GAS AND SYNGAS-DERIVED PRODUCTS"; Ser. No. 12/342,736, entitled "CATALYTIC GASIFICATION PROCESS WITH RECOVERY OF ALKALI METAL FROM CHAR"; Ser. No. 12/343,143, entitled "CATALYTIC GASIFICATION PROCESS WITH RECOVERY OF ALKALI METAL FROM CHAR"; Ser. No. 12/343,159, entitled "CONTINUOUS PROCESSES FOR CONVERTING CARBONACEOUS FEEDSTOCK INTO GASEOUS PRODUCTS"; and Ser. No. 12/342,628, entitled "PROCESSES FOR MAKING SYNGAS-DERIVED PRODUCTS". All of the above are incorporated herein by reference for all purposes as if fully set forth.

All publications, patent applications, patents and other references mentioned herein, if not otherwise indicated, are explicitly incorporated by reference herein in their entirety for all purposes as if fully set forth.

Unless otherwise defined, all technical and scientific terms used herein have the same meaning as commonly understood by one of ordinary skill in the art to which this invention belongs. In case of conflict, the present specification, including definitions, will control.

Except where expressly noted, trademarks are shown in upper case.

Although methods and materials similar or equivalent to those described herein can be used in the practice or testing of the present invention, suitable methods and materials are described herein.

Unless stated otherwise, all percentages, parts, ratios, etc., are by weight.

When an amount, concentration, or other value or parameter is given as a range, or a list of upper and lower values, this is to be understood as specifically disclosing all ranges formed from any pair of any upper and lower range limits, regardless of whether ranges are separately disclosed. Where a range of numerical values is recited herein, unless otherwise stated, the range is intended to include the endpoints thereof, and all integers and fractions within the range. It is not intended that the scope of the present invention be limited to the specific values recited when defining a range.

When the term "about" is used in describing a value or an end-point of a range, the invention should be understood to include the specific value or end-point referred to.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but can include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The use of "a" or "an" to describe the various elements and components herein is merely for convenience and to give a general sense of the invention. This description should be read to include one or at least one and the singular also includes the plural unless it is obvious that it is meant otherwise.

The materials, methods, and examples herein are illustrative only and, except as specifically stated, are not intended to be limiting.

Steam Generating Gasification Reactors

An embodiment of a steam generating gasification reactor (slurry gasifier; 10) of the invention is illustrated in FIG. 1 and utilizes a slurry feedstock in its operation. The slurry feedstock typically comprises water and a carbonaceous material, as discussed below. The reaction bed (80) can be based on a fluidized bed reactor, two stage fluidized bed reactor, counter-current fixed bed reactor, co-current fixed bed reactor, entrained flow reactor, or moving bed reactor. The slurry feedstock is introduced into the reactor according to methods known in the art through a slurry conduit (70). Enriched oxygen gas (or air) as a reactant is supplied through an oxygen gas conduit (40) to the reaction bed. Enriched oxygen can be supplied to the oxygen gas conduit according to methods known to those skilled in the art; for example, the oxygen gas can be supplied from a gas cylinder or from air generation units based on Pressure Swing Adsorption (PSA), Vacuum Swing Adsorption (VSA), Vacuum-Pressure Swing Adsorption (VPSA) and the like. An optional syngas conduit (20) connected to a syngas source (30) allows for supplying a syngas as a reactant and/or fluidization gas to the reactor bed. The syngas can be supplied to the syngas conduit from sources, such as a recycle syngas source for introducing a recycle syngas to the slurry gasifier. Finally, a heated gas conduit (50) allows for exhausting product gases to another preparation process (e.g., a second reactor).

When utilized with a slurry feedstock comprising a carbonaceous material, the slurry gasifier exhaust may comprise a plurality of gases including steam, hydrogen, carbon monoxide and other optional gases such as methane, carbon dioxide, hydrogen sulfide and ammonia, such gases having been generated from the slurry feedstock. The exhaust composition can be controlled based on the composition of the slurry feedstock and/or operating conditions. For example, slurry feedstocks having greater carbon contents can produce higher exhaust concentrations of CO and/or $CO_2$. Further, increased operating temperature can encourage higher concentrations of CO with respect to methane. In general, the steam and the other of the gases are generated at a molar ratio ranging from about 70:30 or from about 60:40, up to about 40:60, or up to about 30:70 (steam: other gases).

In addition, the present slurry gasifier can produce a char (or slag) as a result of the gasification of the slurry feedstock. Typically, the slurry gasifier additionally comprises a conduit for removing char (60) from the base of the gasifier. Appropriate conduits include, but are not limited to, a lock hopper system, although other methods are known to those skilled in the art.

The slurry gasifier temperature will normally be maintained at or above about 450° F., or at or above about 1200° F., and at or below about 2000° F., or at or below about 1600° F.; and the pressure will be at least about 200 psig, or at least about 400 psig, or at least about 600 psig, or at least about 1000 psig, up to about 1500 psig, or up to about 2000 psig, and in particular, about 600 psig to about 2000 psig, or about 1000 psig to about 2000 psig.

In one embodiment, the slurry gasifier of the invention can serve to supply the required steam, via the heated conduit (50), to a catalytic gasification reactor for the production of a gaseous product from a carbonaceous feedstock. Generally, when used as such, the operating temperature and pressure of the slurry gasifier will be greater than the catalytic gasification reactor operating temperature and pressure.

In certain embodiments, the slurry gasifier comprises a fluidized bed reactor (80). In such cases, reaction bed fluidization may be maintained by the introduction of a syngas via the optional syngas conduit (20). In some instances, the syngas source (30) can be a recycle syngas stream from a gas separation operation, as discussed below with respect to integration for catalytic gasification. As necessary, the recycle syngas can be passed through a gas compressor and/or preheater prior to introduction into the slurry gasifier reaction bed.

Advantageously, by preparing steam for a catalytic gasification process in accordance with the present invention, substantially all of the $CO_2$ produced from steam generation is directed through the gas separation and sequestration processes, as discussed below, enabling a greatly decreased carbon footprint as a result.

Slurry Feedstock for Slurry Gasifier

The feedstock supplied to the slurry gasifier typically comprises an aqueous slurry of a carbonaceous material. The aqueous slurry can contain a ratio of carbonaceous material to water, by weight, which ranges from about 5:95 to about 60:40; for example, the ratio can be about 5:95, about 10:90, about 15:85, about 20:80, about 25:75, about 30:70, about 35:65, or about 40:60, or about 50:50, or about 60:40, or any other value inbetween. Any of carbonaceous materials can be used alone or in combination and slurried with water (as necessary) to produce the aqueous slurry with a predetermined carbon and water content. The carbonaceous material for the slurry feedstock can comprise carbon sources containing at least about 20%, or at least about 30%, or at least about 40%, or at least about 50%, or at least about 60%, or at least about 70%, or at least about 80% carbon by dry weight.

The water for preparing the aqueous slurry can either be produced from a clean water feed (e.g., a municipal water supply) and/or recycle processes. For example, reclaimed water from sour water stripping operation (601, FIG. 2) and/or catalytic feedstock drying operations (infra) can be directed for preparation of the aqueous slurry. In one embodiment, the water is not clean but instead contains organic matter, such as untreated wastewater from farming, coal mining, municipal waste treatment facilities or like sources. The organic matter in the wastewater becomes part of the carbonaceous material as indicated below.

The term "carbonaceous material" as used herein refers to any carbonaceous material including, but not limited to coal, petroleum coke, asphaltenes, liquid petroleum residues, used motor oil and other waste processed petroleum sources, untreated or treated sewage waste, garbage, plastics, wood and other biomass, or mixtures thereof.

The term "petroleum coke" as used herein includes (i) the solid thermal decomposition product of high-boiling hydrocarbon fractions obtained in petroleum processing (heavy residues); and (ii) the solid thermal decomposition product of processing tar sands (bituminous sands or oil sands) Such carbonization products include, for example, green, calcined, needle and fluidized bed petroleum coke. Petroleum coke is generally prepared via delayed coking or fluid coking. The petroleum coke can be residual material remaining after retorting tar sands (e.g., mined) are heated to extract any oil.

Resid petcoke can be derived from a crude oil, for example, by coking processes used for upgrading heavy-gravity residual crude oil, which petroleum coke contains ash as a minor component, typically about 1.0 wt % or less, and more typically about 0.5 wt % of less, based on the weight of the coke. Typically, the ash in such lower-ash cokes predominantly comprises metals such as nickel and vanadium.

Tar sands petcoke can be derived from an oil sand, for example, by coking processes used for upgrading oil sand. Tar sands petcoke contains ash as a minor component, typically in the range of about 2 wt % to about 12 wt %, and more typically in the range of about 4 wt % to about 12 wt %, based on the overall weight of the tar sands petcoke. Typically, the ash in such higher-ash cokes predominantly comprises materials such as compounds of silicon and/or aluminum.

The petroleum coke can comprise at least about 70 wt % carbon, at least about 80 wt % carbon, or at least about 90 wt % carbon, based on the total weight of the petroleum coke. Typically, the petroleum coke comprises less than about 20 wt % percent inorganic compounds, based on the weight of the petroleum coke.

The term "liquid petroleum residue" as used herein includes both (i) the liquid thermal decomposition product of high-boiling hydrocarbon fractions obtained in petroleum processing (heavy residues—"resid liquid petroleum residue") and (ii) the liquid thermal decomposition product of processing tar sands (bituminous sands or oil sands—"tar sands liquid petroleum residue"). The liquid petroleum residue is substantially non-solid; for example, it can take the form of a thick fluid or a sludge.

Resid liquid petroleum residue can be derived from a crude oil, for example, by processes used for upgrading heavy-gravity crude oil distillation residue. Such liquid petroleum residue contains ash as a minor component, typically about 1.0 wt % or less, and more typically about 0.5 wt % of less, based on the weight of the residue. Typically, the ash in such lower-ash residues predominantly comprises metals such as nickel and vanadium.

Tar sands liquid petroleum residue can be derived from an oil sand, for example, by processes used for upgrading oil sand. Tar sands liquid petroleum residue contains ash as a minor component, typically in the range of about 2 wt % to about 12 wt %, and more typically in the range of about 4 wt % to about 12 wt %, based on the overall weight of the residue. Typically, the ash in such higher-ash residues predominantly comprises materials such as compounds of silicon and/or aluminum.

The term "coal" as used herein means peat, lignite, subbituminous coal, bituminous coal, anthracite, graphite, or mixtures thereof. In certain embodiments, the coal has a carbon content of less than about 85%, or less than about 80%, or less than about 75%, or less than about 70%, or less than about 65%, or less than about 60%, or less than about 55%, or less than about 50% by weight, based on the total coal weight. In other embodiments, the coal has a carbon content ranging up to about 85%, or up to about 80%, or up to about 75% by weight, based on total coal weight. Examples of useful coals include, but are not limited to, Illinois #6, Pittsburgh #8, Beulah (ND), Utah Blind Canyon, and Powder River Basin (PRB) coals. Anthracite, bituminous coal, subbituminous coal, and lignite coal may contain about 10 wt %, from about 5 to about 7 wt %, from about 4 to about 8 wt %, and from about 9 to about 11 wt %, ash by total weight of the coal on a dry basis, respectively. However, the ash content of any particular coal source will depend on the rank and source of the coal, as is familiar to those skilled in the art. See, for example, "Coal Data: A Reference", Energy Information Administration, Office of Coal, Nuclear, Electric and Alternate Fuels, U.S. Department of Energy, DOE/EIA-0064(93), February 1995.

Asphaltenes typically comprise aromatic carbonaceous solids at room temperature, and can be derived, from example, from the processing of crude oil, oil shale, bitumen, and tar sands.

In addition, the carbonaceous material for the slurry feedstock can comprise the char produced in a catalytic gasification reactor, after gasification catalyst recovery, as discussed below.

Catalytic Gasification Methods

Figure 2:
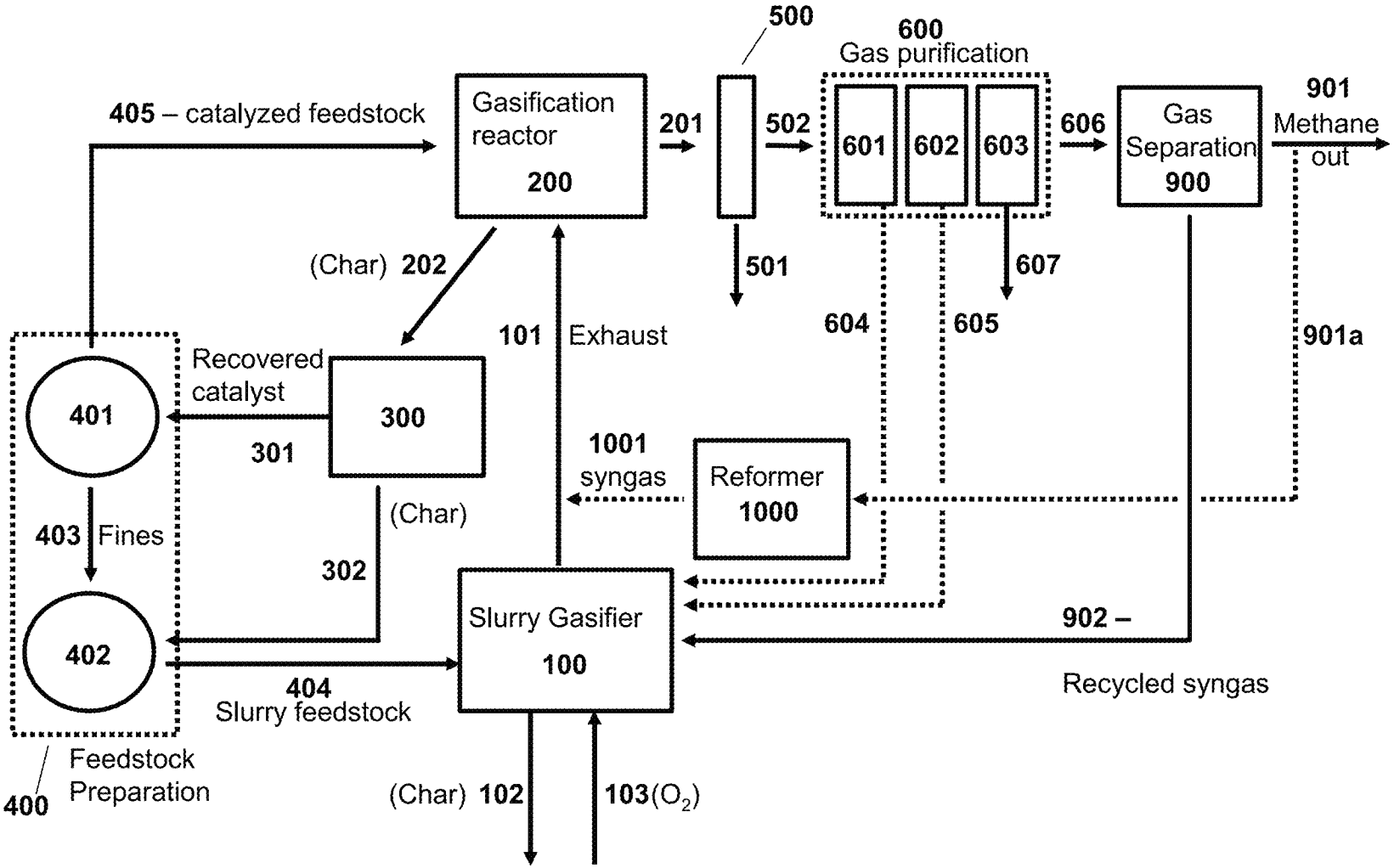
FIG. 2 is a flow chart illustrating a system for generating gases from a carbonaceous feedstock utilizing a gasifier apparatus including a slurry gasifier and a fluidized bed gasifier according to the present invention.

The slurry gasifier (100, FIG. 2) of the present invention is particularly useful in an integrated catalytic gasification process for converting carbonaceous materials to combustible gases, such as methane. A typical flow chart for integration into a process for generating a combustible gas from a carbonaceous feedstock is illustrated in FIG. 2, and referenced herein.

The catalytic gasification reactor (catalytic gasifier; 200) for such processes are typically operated at moderately high pressures and temperature, requiring introduction of the catalyzed feedstock (405) to the reaction zone of the catalytic gasifier while maintaining the required temperature, pressure, and flow rate of the feedstock. Those skilled in the art are familiar with feed systems for providing feedstocks to high pressure and/or temperature environments, including, star feeders, screw feeders, rotary pistons, and lock-hoppers. It should be understood that the feed system can include two or more pressure-balanced elements, such as lock hoppers, which would be used alternately.

The catalyzed feedstock is provided to the catalytic gasifier (200) from a feedstock preparation operation (400), and generally comprises a particulate composition of a crushed carbonaceous material and a gasification catalyst, as discussed below. In some instances, the catalyzed feedstock (405) can be prepared at pressures conditions above the operating pressure of catalytic gasifier. Hence, the catalyzed feedstock (405) can be directly passed into the catalytic gasifier without further pressurization.

Any of several catalytic gasifiers (200) can be utilized in the process of the described herein. Suitable gasifiers include counter-current fixed bed, co-current fixed bed, fluidized bed, entrained flow, and moving bed reactors. The pressure in the catalytic gasifier (200) typically can be from about 10 to about 100 atm (from about 150 to about 1500 psig). The gasification reactor temperature can be maintained around at least about 450° C., or at least about 600° C., or at least about 900° C., or at least about 750° C., or about 600° C. to about 700° C.; and at pressures of at least about 50 psig, or at least about 200 psig, or at least about 400 psig, to about 1000 psig, or to about 700 psig, or to about 600 psig.

The gas utilized in the catalytic gasifier for pressurization and reactions of the particulate composition comprises steam, and optionally, oxygen or air. The latter can be supplied, as necessary, to the reactor according to methods known to those skilled in the art (not shown in FIG. 2).

Steam is supplied to the catalytic gasifier from the exhaust (101) of the slurry gasifier (100) of the present invention and is conveyed via a heated gas conduit from the slurry gasifier to the catalytic gasifier (200). The slurry gasifier (100) is fed with a slurry feedstock (404), as discussed previously, from a slurry feedstock preparation operation (402) and an enriched oxygen gas stream (103). Therein, in one example, fines (403) generated in the crushing of carbonaceous materials for the preparation of the catalyzed feedstock (401) for the catalytic gasifier can be used in preparing (402) the present slurry feedstock (404). Notably, a second source for fines can be from waste fines from bituminous coal cleaning and existing waste coal impoundments or ponds, thereby aiding in improving and preventing environmental pollution as a result of mining and processing operations.

Recycled steam from other process operations can also be used for supplementing steam to the catalytic gasifier. For example in the preparation of the catalyzed feedstock, when slurried particulate composition are dried with a fluid bed slurry drier, as discussed previously, then the steam generated can be fed to the catalytic gasification reactor (200).

The small amount of required heat input for the catalytic gasifier can be provided by superheating a gas mixture of steam and recycle gas feeding the gasification reactor by any method known to one skilled in the art. In one method, compressed recycle gas of CO and $H_2$ can be mixed with steam and the resulting steam/recycle gas mixture can be further superheated by heat exchange with the catalytic gasifier effluent followed by superheating in a recycle gas furnace.

A methane reformer (1000) can be optionally included in the process to supplement the recycle CO and $H_2$ stream and the exhaust (101) from the slurry gasifier to ensure that the catalytic gasifier is run under substantially thermally neutral (adiabatic) conditions. In such instances, methane (901*a*) can be supplied for the reformer from the methane product (901), as described below.

Reaction of the catalyzed feedstock (405) in the catalytic gasifier (200) and the slurry feedstock (404) in the slurry gasifier (100), under the described conditions, provides a crude product gas and a char (202) from the catalytic gasification reactor and an exhaust gas (101) and char (102) for the slurry gasifier.

The char produced in the catalytic gasifier (202) processes is typically removed from the catalytic gasifier for sampling, purging, and/or catalyst recovery in a continuous or batchwise manner. Methods for removing char are well known to those skilled in the art. One such method taught by EP-A-0102828, for example, can be employed. The char can be periodically withdrawn from the catalytic gasification reactor through a lock hopper system, although other methods are known to those skilled in the art.

Often, the char (202) from the catalytic gasifier is directed to a catalyst recovery and recycle process (300). Processes have been developed to recover alkali metal from the solid purge in order to reduce raw material costs and to minimize environmental impact of a catalytic gasification process. For example, the char (202) can be quenched with recycle gas and water and directed to a catalyst recycling operation for extraction and reuse of the alkali metal catalyst. Particularly useful recovery and recycling processes are described in U.S. Pat. No. 4,459,138, as well as previously incorporated U.S. Pat. No. 4,057,512, US2007/0277437A1, U.S. patent application Ser. No. 12/342,554, entitled "CATALYTIC GASIFICATION PROCESS WITH RECOVERY OF ALKALI METAL FROM CHAR", U.S. patent application Ser. No. 12/342,715, entitled "CATALYTIC GASIFICATION PROCESS WITH RECOVERY OF ALKALI METAL FROM CHAR", U.S. patent application Ser. No. 12/342,736, entitled "CATALYTIC GASIFICATION PROCESS WITH RECOVERY OF ALKALI METAL FROM CHAR", and U.S. patent application Ser. No. 12/343,143, entitled "CATALYTIC GASIFICATION PROCESS WITH RECOVERY OF ALKALI METAL FROM CHAR". Reference can be had to those documents for further process details.

Upon completion of catalyst recovery, both the char, substantially free of the gasification catalysts (302) as described herein, and the recovered catalyst (301) (as a solution or solid) can be directed to the feedstock preparation operation (400) comprising a catalyzed feedstock preparation process (401) and a slurry feedstock preparation process (402), as described herein.

The char (102) produced in the slurry gasifier (100) reactor is typically removed via similar methods to those described for the catalytic gasification reactor. However, the char (102) from the slurry gasifier (100) is not normally processed through catalyst recovery, but rather, can be processed for disposal.

Crude product gas effluent (201) leaving the catalytic gasifier (200) can pass through a portion of the reactor which serves as a disengagement zone where particles too heavy to be entrained by the gas leaving the reactor (i.e., fines) are returned to the fluidized bed. The disengagement zone can include one or more internal cyclone separators or similar devices for removing fines and particulates from the gas. The gas effluent (201) passing through the disengagement zone and leaving the catalytic gasifier generally contains $CH_4$, $CO_2$, $H_2$ and CO, $H_2S$, $NH_3$, unreacted steam, entrained fines, and other contaminants such as COS.

The gas stream from which the fines have been removed (201) can then be passed through a heat exchanger (500) to cool the gas and the recovered heat can be used to preheat recycle gas and generate high pressure steam (501). Residual entrained fines can also be removed by any suitable means such as external cyclone separators followed by Venturi scrubbers. The recovered fines can be processed to recover alkali metal catalyst then passed to the slurry feedstock preparation process (402) or returned to the catalytic gasification reactor (100).

The gas stream (502) exiting the Venturi scrubbers can be fed to a gas purification operation (600) comprising COS hydrolysis reactors (601) for COS removal (sour process) and further cooled in a heat exchanger to recover residual heat prior to entering water scrubbers (602) for ammonia recovery, yielding a scrubbed gas comprising at least $H_2S$, $CO_2$, CO, $H_2$ and $CH_4$. Methods for COS hydrolysis are known to those skilled in the art, for example, see U.S. Pat. No. 4,100,256. The residual heat from the scrubbed gas can be used to generate low pressure steam.

Scrubber water (605) and sour process condensate (604) can be processed to strip and recover $H_2S$, $CO_2$ and $NH_3$; such processes are well known to those skilled in the art. $NH_3$ can typically be recovered as an aqueous solution (e.g., 20 wt %). Alternatively, scrubber water (605) and sour process condensate (604) can be returned to the slurry gasifier, thereby reducing overall process water usage and eliminating separate cleanup of these process streams.

A subsequent acid gas removal process (603) can be used to remove $H_2S$ and $CO_2$ from the scrubbed gas stream by a physical absorption method involving solvent treatment of the gas to give a cleaned gas stream. Such processes involve contacting the scrubbed gas with a solvent such as monoethanolamine, diethanolamine, methyldiethanolamine, diisopropylamine, diglycolamine, a solution of sodium salts of amino acids, methanol, hot potassium carbonate or the like. One method can involve the use of Selexol® (UOP LLC, Des Plaines, Ill. USA) or Rectisol® (Lurgi AG, Frankfurt am Main, Germany) solvent having two trains; each train consisting of an $H_2S$ absorber and a $CO_2$ absorber. The spent solvent (607) containing $H_2S$, $CO_2$ and other contaminants can be regenerated by any method known to those skilled in the art, including contacting the spent solvent with steam or other stripping gas to remove the contaminants or by passing the spent solvent through stripper columns. Recovered acid gases can be sent for sulfur recovery processing; for example, any recovered $H_2S$ from the acid gas removal and sour water stripping can be converted to elemental sulfur by any method known to those skilled in the art, including the Claus process. Sulfur can be recovered as a molten liquid. Stripped water can be directed for recycled use in preparation of the catalyzed feedstock and/or slurry feedstock.

Advantageously, $CO_2$ generated in the process, whether in the steam generation or catalytic gasification or both, can be recovered for subsequent use or sequestration, enabling a greatly decreased carbon footprint (as compared to direct combustion of the feedstock) as a result.

The resulting cleaned gas stream (606) exiting the gas purification operation (600) contains mostly $CH_4$, $H_2$, and CO and, typically, small amounts of $CO_2$ and $H_2O$. The cleaned gas stream (606) can be further processed to separate and recover $CH_4$ by any suitable gas separation method (900) known to those skilled in the art including, but not limited to, cryogenic distillation and the use of molecular sieves or ceramic membranes. One method for recovering $CH_4$ from the cleaned gas stream involves the combined use of molecular sieve absorbers to remove residual $H_2O$ and $CO_2$, and cryogenic distillation to fractionate and recover $CH_4$. Typically, two gas streams can be produced by the gas separation process (900), a methane product stream (901) and a syngas stream (902, $H_2$ and CO).

The syngas stream (902) can be compressed and recycled. One option can be to recycle the syngas steam directly to the catalytic gasifier (200). In one case, the recycled syngas is combined with the exhaust gas (101) from the slurry gasifier, and the mixture introduced into the catalytic gasification reactor (200). In another case, as exemplified in FIG. 2, the recycled syngas (902) can be directed into the slurry gasifier (100). When a fluid bed reactor is utilized for the slurry gasifier (100), the syngas may provide fluidization or aid in fluidization of the reaction bed.

If necessary, a portion of the methane product (901*a*) can be directed to a reformer (1000), as discussed previously. The need to direct a portion of the methane product can be controlled, for example, by the ratio of CO to $H_2$ in the exhaust gas from the slurry gasifier (100). Particularly, methane can be directed to a reformer to supplement (1001) the exhaust gas (101) supplied to the catalytic gasification reactor and, in some instance, provide a ratio of about 3:1 of $H_2$ to CO in the feed to the catalytic gasification reactor. A portion of the methane product can also be used as plant fuel for a gas turbine.

Feedstock for Catalytic Gasification

The catalyzed feedstock (405) for the catalytic gasifier typically comprises at least one carbonaceous material, as discussed previously, and a gasification catalyst.

The catalyzed feedstock is typically supplied as a fine particulate having an average particle size of from about 250 microns, or from about 25 microns, up to about 500, or up to about 2500 microns. One skilled in the art can readily determine the appropriate particle size for the individual particulates and the catalyzed feedstock. For example, when a fluid bed gasification reactor is used, the catalyzed feedstock can have an average particle size which enables incipient fluidization of the catalyzed feedstock at the gas velocity used in the fluid bed gasification reactor.

Catalyst Components

The catalyzed feedstock further comprises an amount of an alkali metal component, as alkali metal and/or a compound containing alkali metal, as well as optional co-catalysts, as disclosed in the previous incorporated references. Typically, the quantity of the alkali metal component in the composition is sufficient to provide a ratio of alkali metal atoms to carbon atoms ranging from about 0.01, or from about 0.02, or from about 0.03, or from about 0.04, to about 0.06, or to about 0.07, or to about 0.08. Further, the alkali metal is typically loaded onto a carbon source to achieve an alkali metal content of from about 3 to about 10 times more than the combined ash content of the carbonaceous material (e.g., coal and/or petroleum coke), on a mass basis.

Suitable alkali metals are lithium, sodium, potassium, rubidium, cesium, and mixtures thereof. Particularly useful are potassium sources. Suitable alkali metal compounds include alkali metal carbonates, bicarbonates, formates, oxalates, amides, hydroxides, acetates, or similar compounds. For example, the catalyst can comprise one or more of $Na_2CO_3$, $K_2CO_3$, $Rb_2CO_3$, $Li_2CO_3$, $Cs_2CO_3$, NaOH, KOH, RbOH or CsOH, and particularly, potassium carbonate and/or potassium hydroxide.

Methods for Making the Catalyzed Feedstock

The carbonaceous material for use in the preparation of the particulate composition can require initial processing to prepare the catalyzed feedstock (405) for catalytic gasification. For example, when using a catalyzed feedstock comprising a mixture of two or more carbonaceous materials, such as petroleum coke and coal, the petroleum coke and coal can be separately processed to add catalyst to one or both portions, and subsequently mixed. Alternately, the carbonaceous materials can be combined immediately prior to the addition of a catalyst.

The carbonaceous materials can be crushed and/or ground according to any methods known in the art, such as impact crushing and wet or dry grinding to yield particulates of each. Depending on the method utilized for crushing and/or grinding of the carbonaceous material, the resulting particulates can be sized (i.e., separated according to size) to provide an appropriate feedstock.

Any method known to those skilled in the art can be used to size the particulates. For example, sizing can be preformed by screening or passing the particulates through a screen or number of screens. Screening equipment can include grizzlies, bar screens, and wire mesh screens. Screens can be static or incorporate mechanisms to shake or vibrate the screen. Alternatively, classification can be used to separate the petroleum coke and coal particulates. Classification equipment can include ore sorters, gas cyclones, hydrocyclones, rake classifiers, rotating trommels, or fluidized classifiers. The carbonaceous material can be also sized or classified prior to grinding and/or crushing. Any fines (403) separated from the preparation process can be directed to preparation (402) of the slurry feedstock for the slurry gasification reactor (100), as discussed previously.

Additional feedstock processing steps may be necessary depending on the qualities of carbonaceous materials. For example, carbonaceous materials containing high moisture levels, such as raw and/or treated sewage and high-moisture coals, can require drying prior to crushing. Some caking coals can require partial oxidation to simplify gasification reactor operation. Various coals deficient in ion-exchange sites can be pre-treated to create additional ion-exchange sites to facilitate catalysts loading and/or association. Such pre-treatments can be accomplished by any method known to the art that creates ion-exchange capable sites and/or enhances the porosity of a coal feed (see, for example, previously incorporated U.S. Pat. No. 4,468,231 and GB1599932). Often, pre-treatment is accomplished in an oxidative manner using any oxidant known to the art.

In one example, coal is typically wet ground and sized (e.g., to a particle size distribution of about 25 to 2500 microns) and then drained of its free water (i.e., dewatered) to a wet cake consistency. Examples of suitable methods for the wet grinding, sizing, and dewatering are known to those skilled in the art; for example, see previously incorporated U.S. patent application Ser. No. 12/178,380 (filed 23 Jul. 2008).

Any methods known to those skilled in the art can be used to associate one or more gasification catalysts with the carbonaceous material. Such methods include but are not limited to, admixing with a solid catalyst source, impregnating the catalyst on to the carbonaceous material particulate, incipient wetness impregnation, evaporative impregnation, vacuum impregnation, dip impregnation, and combinations of these methods. Gasification catalysts can be impregnated into the carbonaceous materials (i.e., particulate) by slurrying with a solution (e.g., aqueous) of the catalyst.

The carbonaceous material particulate can be treated to associate at least a first catalyst (e.g., gasification catalyst) therewith, providing the catalyzed feedstock. In some cases, a second catalyst (e.g., co-catalyst) can be provided; in such instances, the particulate can be treated in separate processing steps to provide the first catalyst and second catalysts. For example, the primary gasification catalyst can be supplied (e.g., a potassium and/or sodium source), followed by a separate treatment to provide a co-catalyst source. Alternatively, the first and second catalysts can be provided as a mixture in a single treatment.

One particular method suitable for combining coals with the gasification catalysts and optional co-catalysts to provide a particulate composition where the various components have been associated with the coal particulate via ion exchange is described in previously incorporated U.S. patent application Ser. No. 12/178,380 (filed 23 Jul. 2008). The ion exchange loading mechanism is maximized (based on adsorption isotherms specifically developed for the coal), and the additional catalyst retained on wet including those inside the pores is controlled so that the total catalyst target value is obtained in a controlled manner. Such loading provides a particulate composition as a wet cake. The catalyst loaded and dewatered wet coal cake typically contains, for example, about 50% moisture. The total amount of catalyst loaded is controlled by controlling the concentration of catalyst components in the solution, as well as the contact time, temperature and method, as can be readily determined by those of ordinary skill in the relevant art based on the characteristics of the starting coal.

Additional particulates derived from carbonaceous materials can be combined with the catalyzed feedstock prior to introduction into the catalytic gasification reactor by any methods known to those skilled in the art. For example, a catalyzed feedstock comprising a coal particulate and a gasification catalyst can be combined with biomass. Such methods include, but are not limited to, kneading, and vertical or horizontal mixers, for example, single or twin screw, ribbon, or drum mixers. The catalyzed feedstock (405) can be stored for future use or transferred to a feed operation for introduction into a gasification reactor. The catalyzed feedstock (405) can be conveyed to storage or feed operations according to any methods known to those skilled in the art, for example, a screw conveyer or pneumatic transport.

EXAMPLES

Example 1

Catalyzed and Slurry Feedstock Preparation

As-received coal (Powder River Basin) can be stage-crushed to maximize the amount of material having particle sizes ranging from about 0.85 to about 1.4 mm. Fines (<0.85 mm) can be separated from the crushed materials by vibratory screening and directed for preparation of the slurry feedstock.

The crushed coal can be slurried with an aqueous solution of potassium carbonate, dewatered, and dried via a fluid bed slurry drier to yield a catalyzed feedstock containing 185 lb coal (88 wt %), 14.9 lb catalyst (7 wt %), and 10.5 lb moisture (5 wt %). The coal fines separated at the crushing stage can be slurried with water to a composition of 75 wt % water (263 lb) and 25 wt % coal fines (88 lb) by weight and subsequently can be used as the slurry feedstock for the slurry gasifier.

Example 2

Catalytic Gasification

The slurry feedstock of Example 1 can be provided to a fluidized bed gasification reactor (slurry gasifier) fed by an enriched oxygen source (96 lb/hr) and a syngas source (17.7 w % $H_2$, 82.3% CO; 75.48 lb/hr). Typical gasification conditions for the slurry gasifier would be: total pressure 550 psi, and temperature, 1700-1900° F.; char would be generated at a rate of 12.1 lb/hr.

The resulting exhaust (561.6 lb/hr) from the slurry gasifier would contain steam (277.5 lb/hr), hydrogen (12.89 lb/hr), CO (62.27 lb/hr), $CO_2$ (187.84 lb/hr) and methane (11.06 lb/hr), and could be provided to a second fluidized bed gasification reactor (catalytic gasifier) supplied with the catalyzed feedstock (210 lb/hr) of Example 1. The catalyzed feedstock would be introduced under a positive pressure of nitrogen (45.8 lb/hr). Typical conditions for the catalytic gasifier would be: total pressure, 500 psi and temperature, 1200° F. The effluent of the catalytic gasifier (34.46 lb/hr) would contain methane (17.7 mol %), $CO_2$ (23.0 mol %), $H_2$ (17 mol. %), CO (8.2 mol %), water (28.9 mol %), $H_2S$ (0.1 mol %), ammonia (0.3 mol %), and nitrogen (4.7 mol %).

We claim:

1. A process for converting a carbonaceous material into a first plurality of gases comprising methane, hydrogen, carbon monoxide, carbon dioxide, hydrogen sulfide, ammonia and other higher hydrocarbons, the process comprising the steps of:

(a) providing a gasifier apparatus comprising: (1) a fluidized bed gasifier configured to receive a catalyzed carbonaceous feedstock and a second plurality of gases comprising steam, hydrogen, carbon monoxide, and carbon dioxide, and to exhaust the first plurality of gases; and (2) a slurry gasifier configured to supply to the fluidized bed gasifier the second plurality of gases, wherein the slurry gasifier comprises:

a gasifier chamber;

a syngas conduit in communication with a syngas source and the gasifier chamber for supplying a syngas to the gasifier chamber;

an oxygen gas conduit for supplying enriched oxygen gas as a reactant to the gasifier chamber;

a slurry conduit for supplying an aqueous carbonaceous slurry as a reactant to the gasifier chamber; and a heated gas conduit for exhausting the second plurality of gases;

wherein the heated gas conduit of the slurry gasifier is in communication with the fluidized bed gasifier for supplying the second plurality of gases from the slurry gasifier to the fluidized bed gasifier;

(b) supplying a particulate composition comprising the carbonaceous material and a gasification catalyst to the fluidized bed gasifier, wherein the gasification catalyst, in the presence of steam and under suitable temperature and pressure, exhibits gasification activity whereby the first plurality of gases is formed;

(c) supplying an aqueous carbonaceous slurry via the slurry conduit, an enriched oxygen gas via the oxygen gas conduit, and a syngas via the syngas conduit, to the slurry gasifier;

(d) reacting the aqueous carbonaceous slurry in the slurry gasifier in the presence of oxygen and under suitable temperature and pressure so as to generate the second plurality of gases;

(e) introducing the second plurality of gases into the fluidized bed gasifier via the heated gas conduit;

(f) reacting the particulate composition in the fluidized bed gasifier in the presence of the second plurality of gases, at a temperature of at least about 450° C. to about 750° C. and a pressure of at least about 50 psig to about 1000 psig, to form the first plurality of gases; and (g) at least partially separating the first plurality of gases to produce a recycle syngas stream;

(h) supplying the recycle syngas stream to the gasifier chamber of the slurry gasifier as the syngas;

wherein:

(i) the gasification catalyst comprises a source of at least one alkali metal and is present in an amount sufficient to provide, in the particulate composition, a ratio of alkali metal atoms to carbon atoms ranging from about 0.01 to about 0.08; and (ii) the aqueous carbonaceous slurry comprises a mixture of carbonaceous material and water at a weight ratio ranging from about 5:95 to about 40:60.

2. The process according to claim 1, wherein the alkali metal comprises potassium and/or sodium.

3. The process according to claim 1, wherein the steam and other of the second plurality of gases are generated at a molar ratio ranging from about 70:30 to about 30:70 (steam: other gases).

4. The process according to claim 1, wherein the carbon dioxide in the first plurality of gases is recovered.

5. The process according to claim 4, wherein the carbon dioxide is generated in step (d), step (f) or both.

6. The process according to claim 4, wherein the carbon dioxide is generated in both step (d) and step (f).

7. The process according to claim 1, wherein the operating temperature and pressure of the slurry gasifier is greater than the fluidized bed gasifier.

8. The process according to claim 1, wherein the particulate composition is prepared by crushing a carbonaceous material, fines are generated in the crushing of the carbonaceous material, and the aqueous carbonaceous slurry comprises the fines.

9. The process according to claim 1, wherein a char is formed in step (f), and the char is removed from the fluidized bed gasifier and sent to a catalyst recovery and recycle process.

10. The process according to claim 9, wherein the aqueous carbonaceous slurry comprises char from the catalyst recovery and recycle process that is substantially free of gasification catalyst.

* * * * *